US011731863B2

(12) United States Patent
Konate et al.

(10) Patent No.: US 11,731,863 B2
(45) Date of Patent: Aug. 22, 2023

(54) KNUCKLE BOOM CRANE, FOR OFFSHORE APPLICATION

(71) Applicant: REEL, Saint-Cyr-Au-Mont-d'Or (FR)

(72) Inventors: Karamoko Konate, Saint-Rogatien (FR); Jean-Marc Erdimelian, Lyons (FR)

(73) Assignee: REEL, Saint-Cyr-au-Mont-d'Or (FR)

( * ) Notice: Subject to any disclaimer, the term of this patent is extended or adjusted under 35 U.S.C. 154(b) by 225 days.

(21) Appl. No.: 17/128,670

(22) Filed: Dec. 21, 2020

(65) Prior Publication Data

US 2022/0073322 A1 Mar. 10, 2022

(30) Foreign Application Priority Data

Dec. 24, 2019 (FR) ..... 19 15585

(51) Int. Cl.
*B66C 23/52* (2006.01)
*B66C 13/04* (2006.01)
*B66C 23/68* (2006.01)

(52) U.S. Cl.
CPC ..... *B66C 23/52* (2013.01); *B66C 13/04* (2013.01); *B66C 23/68* (2013.01)

(58) Field of Classification Search
CPC ..... B66C 13/04; B66C 23/42; B66C 23/52; B66C 23/54; B66C 23/68; B63B 27/10; B63B 27/30
USPC ..... 254/277
See application file for complete search history.

(56) References Cited

U.S. PATENT DOCUMENTS

| | | | |
|---|---|---|---|
| 3,039,213 | A | 6/1962 | Allin, Jr. |
| D199,398 | S | 10/1964 | Allin, Jr. |
| 5,215,202 | A | 6/1993 | Fujimoto |
| 9,132,557 | B2 | 9/2015 | Yamada et al. |
| 2012/0186380 | A1 | 7/2012 | Yamada et al. |

FOREIGN PATENT DOCUMENTS

| | | |
|---|---|---|
| AT | 12 086 | 10/2011 |
| CN | 201325840 Y | 10/2009 |
| DE | 1 287 779 | 1/1969 |
| EP | 0 124 947 | 11/1984 |

(Continued)

OTHER PUBLICATIONS

Search Report for FR 1915585 dated Sep. 7, 2020, 1 page.

(Continued)

*Primary Examiner* — Michael R Mansen
*Assistant Examiner* — Henrix Soto
(74) *Attorney, Agent, or Firm* — Nixon & Vanderhye

(57) ABSTRACT

Disclosed is a knuckle boom crane for offshore application, wherein the crane includes a knuckle boom, carried by a support structure and equipped with an operating unit. The knuckle boom includes a main boom and a terminal boom. The operating unit of the knuckle boom include at least one downstream linear actuator, arranged between the main boom and the terminal boom, for the rotational operation of the terminal boom about a downstream articulation axis. And the at least one downstream linear actuator is fastened to one of the lateral faces of the main boom and to one of the lateral faces of the terminal boom, in order to provide an improved lever arm between the main boom and the terminal boom.

18 Claims, 4 Drawing Sheets

(56) References Cited

FOREIGN PATENT DOCUMENTS

| | | | | | |
|---|---|---|---|---|---|
| EP | 1 770 050 | | | 4/2007 | |
| EP | 1770050 | A1 | * | 4/2007 | ..... B66C 23/68 |
| EP | 1770050 | B1 | | 12/2009 | |
| EP | 2195273 | A2 | | 6/2010 | |
| EP | 2520484 | A3 | | 3/2014 | |
| EP | 2943396 | A1 | | 11/2015 | |
| EP | 3 390 265 | | | 10/2018 | |
| EP | 3153396 | B1 | | 12/2018 | |
| EP | 3390265 | B1 | | 10/2019 | |
| EP | 3532424 | B1 | | 12/2021 | |
| JP | 2001-317077 | A | | 11/2001 | |
| NL | 2013384 | B1 | | 9/2016 | |
| RU | 2178382 | C1 | | 1/2002 | |
| RU | 142452 | U1 | | 6/2014 | |
| SU | 1070116 | A | * | 1/1984 | ..... B66C 23/16 |
| WO | WO 2009036456 | A2 | * | 3/2009 | ..... B66C 23/54 |
| WO | WO 2014109637 | A1 | * | 7/2014 | ..... B63B 27/10 |
| WO | 2014/200354 | | | 12/2014 | |
| WO | WO 2014200354 | A1 | * | 12/2014 | ..... B63B 27/10 |
| WO | 2017/103139 | | | 6/2017 | |
| WO | 2018/080403 | A1 | | 5/2018 | |

OTHER PUBLICATIONS

Third Party Observation in European Patent Application No. 20216117.0 dated Apr. 6, 2023.

Deme, "Activity Report 2018," Catalog, 2018, 85 pages.

Deme, "Activity Report 2019," Catalog, 2019, 87 pages.

Ehm, "Cardanic Ring and Trunnion Mounts," Fluid Power Journal, 2019, https://fluidpowerjournal.com/cardanic-ring-trunnion-mounts/, 5 pages.

Huisman Equipment BV, Knuckle boom cylinder Design Report, 2014, 15 pages.

Bak et al.,"Analysis of Offshore Knuckle Boom Crane—Part One: Modeling and Parameter Identification," Modeling, Identification and Control, vol. 34, No. 4, 2013, pp. 157-174, ISSN 1890-1328.

* cited by examiner

KNUCKLE BOOM CRANE, FOR OFFSHORE APPLICATION

BACKGROUND OF THE INVENTION

Cross-Reference to Related Application

This application claims priority to FR Patent Application No. 19 15585 filed Dec. 24, 2019, the entire contents of which are hereby incorporated by reference.

FIELD OF THE INVENTION

The present invention relates to the technical field of marine cranes, and in particular that of knuckle boom cranes for offshore applications.

DESCRIPTION OF THE RELATED ART

In the offshore field, it is common that the vessels used are equipped with a knuckle boom crane.

The use of such knuckle boom cranes in the offshore field is interesting in particular with regard to their reaches and maximum loads.

For that purpose, such a knuckle boom conventionally comprises two successive booms: a support boom and a terminal boom.

The support boom (commonly called "main boom") is conventionally articulated to a support structure. The terminal boom (commonly called "jib") is for its part conventionally articulated to the support boom.

The operation of these two knuckle boom parts is conventionally made using hydraulic jacks:

- first jacks are implanted between the support structure and the support boom, for the operation of the latter, and
- second jacks are implanted between the parts of the knuckle boom, for the operation of the terminal boom.

Defining the stroke and attachment points of these jacks makes it possible to optimize the reach and capacity of this system.

Herein, the second jacks are conventionally implanted between the opposite faces of the two parts of the knuckle boom: the upstream end of the cylinder is fastened to the main boom and the downstream end of the rod is fastened to the knuckle boom.

However, the present structure of the knuckle booms has intrinsic limits in two points:

- the articulation angle between the parts of the knuckle boom, generally of the order of 120°, and
- the capacity of the knuckle boom to support a load in a given position, especially when the jack is fully retracted or fully extended.

SUMMARY OF THE INVENTION

In order to remedy the above-mentioned drawback of the state of the art, the present invention proposes a knuckle boom crane for offshore application, wherein said crane comprises:

- a support structure,
- a knuckle boom, carried by said support structure and equipped with operating means,
- a winch drum, associated with rotating means and intended to receive an elongated lift member (for example, a cable, advantageously a metal cable or a synthetic cable).

The knuckle boom comprises a main boom and a terminal boom, in series, each comprising:

- two lateral faces,
- an upstream end, located on the side of the support structure, and
- a down stream end, remote from the support structure.

The support structure and the upstream end of the main boom cooperate through upstream articulation means defining an upstream articulation axis.

The downstream end of the main boom and the upstream end of the terminal boom cooperate through downstream articulation means defining a downstream articulation axis.

The upstream and downstream articulation axes advantageously extend parallel to each other.

The means for operating said knuckle boom comprise:

- at least one upstream linear actuator arranged between said support structure and said main boom, for the rotational operation of said main boom about said upstream articulation axis, and
- at least one downstream linear actuator, arranged between said main boom and said terminal boom, for the rotational operation of said terminal boom about said downstream articulation axis.

And, according to the invention, said at least one downstream linear actuator is fastened, on the one hand, to one of the lateral faces of the support arm and, on the other hand, to one of the lateral faces of said terminal boom.

Such a configuration has in particular for interest to provide an improved lever arm between the main boom and the terminal boom.

This new design also makes it possible to increase the articulation angle between the parts of the knuckle boom.

And this arrangement of the downstream linear actuator also makes it possible to improve the capacity of the knuckle boom to support a load in a given position, in particular when the downstream linear actuator is fully retracted or fully extended.

Other non-limitative and advantageous features of the system according to the invention, taken individually or according to all the technically possible combinations, are the following:

- said at least one downstream linear actuator is inscribed in a cylindrical bulk, and said main and terminal booms are each inscribed in a lateral bulk defined by vertical planes passing through said lateral faces, and said cylindrical bulk of said at least one downstream linear actuator extends out of the lateral bulk of said main and terminal booms;
- the operating means comprise two downstream linear actuators, identical and coplanar to each other, implanted on either side of said main boom and said terminal boom;
- said at least one downstream linear actuator is fastened to one of the lateral faces of said main boom through upstream assembly means in the form of a universal joint (also named cardan joint, hooke's joint or U-joint), and to one of the lateral faces of said terminal boom through downstream assembly means in the form of a ball joint (the "ball joint" function of the universal joint releases the rotations and eliminates the parasitic moments, in particular the parasitic bending moments); preferably, the upstream assembly means comprise spider carrying said at least one downstream linear actuator, and at least one yoke, carrying said spider and assembled to the lateral face of said main boom;
- said at least one linear actuator comprises a cylinder and a rod, wherein said cylinder has an upstream end, remote from the rod, and a downstream end, on the side of the rod, and the upstream assembly means are fastened to said cylinder, remote from said upstream end, advantageously at said downstream end, and the downstream assembly means are fastened to the free end of said rod, still preferably with the closing ring of the cylinder of the downstream linear actuator; this mounting of the downstream linear actuator optimizes the buckling length that is limited to only the extended rod length (and no longer to the total length of this downstream linear actuator); the cylinder of the downstream linear actuator extends, partially or fully, in protrusion with respect to the upstream assembly means;

said at least one linear actuator consists of a hydraulic jack or an electric jack.

The present invention also relates to a vessel for offshore application, equipped with a knuckle boom crane according to the invention.

Of course, the different features, variants and embodiments of the invention can be associated with each other according to various combinations, insofar as they are not incompatible or exclusive with respect to each other.

BRIEF DESCRIPTION OF THE DRAWINGS

Moreover, various other features of the invention emerge from the appended description made with reference to the drawings that illustrate non-limitative embodiments of the invention, and wherein.

DESCRIPTION OF THE PREFERRED EMBODIMENTS

Figure 1:
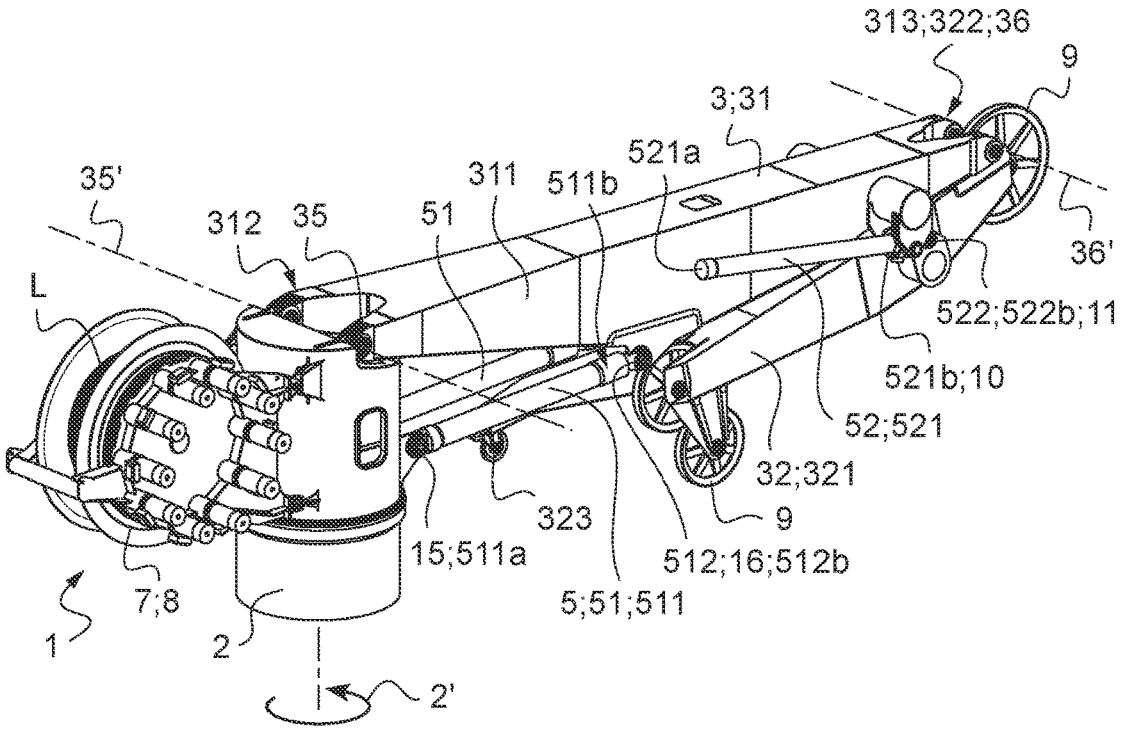
FIG. 1 is an overall and perspective view of the knuckle boom crane according to the invention, whose knuckle boom is in a folded configuration.
Figure 2:
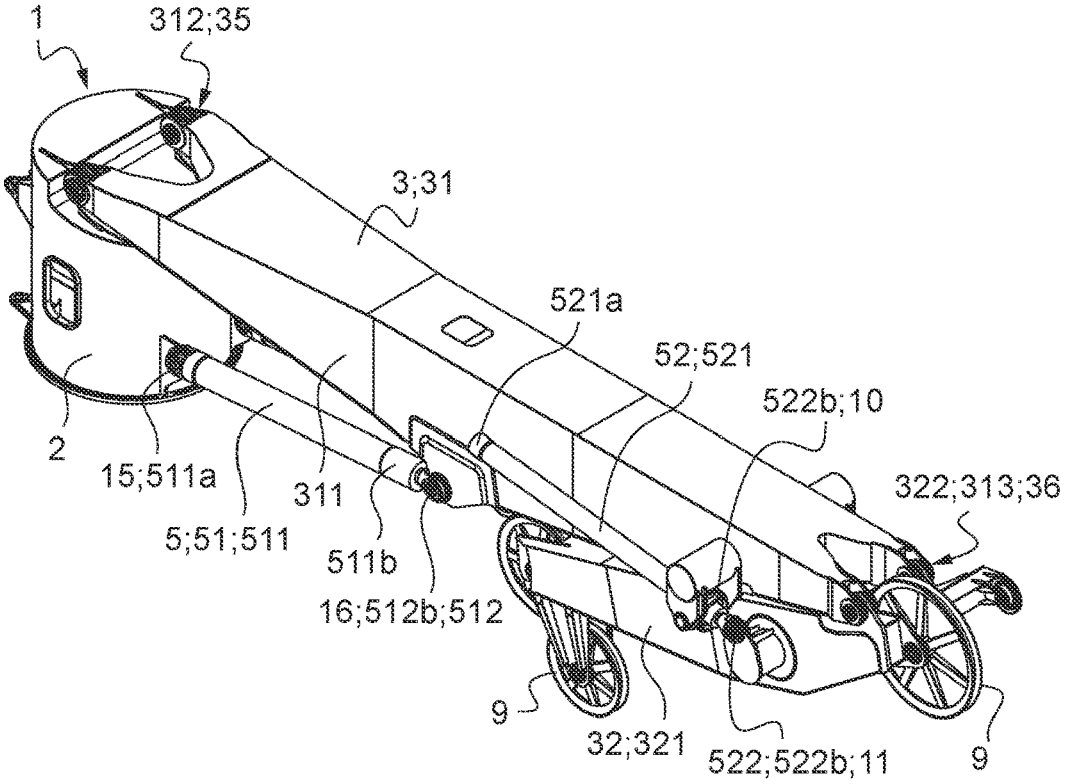
FIG. 2 is an overall and perspective view of the knuckle boom crane according to FIG. 1.
Figure 3:
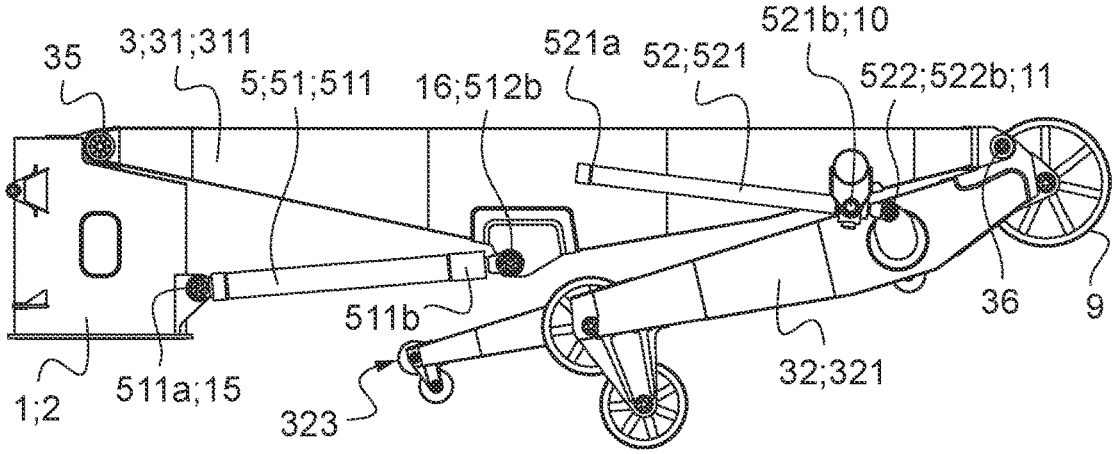
FIG. 3 is an overall and side view of the knuckle boom crane according to FIG. 1.
Figure 4:
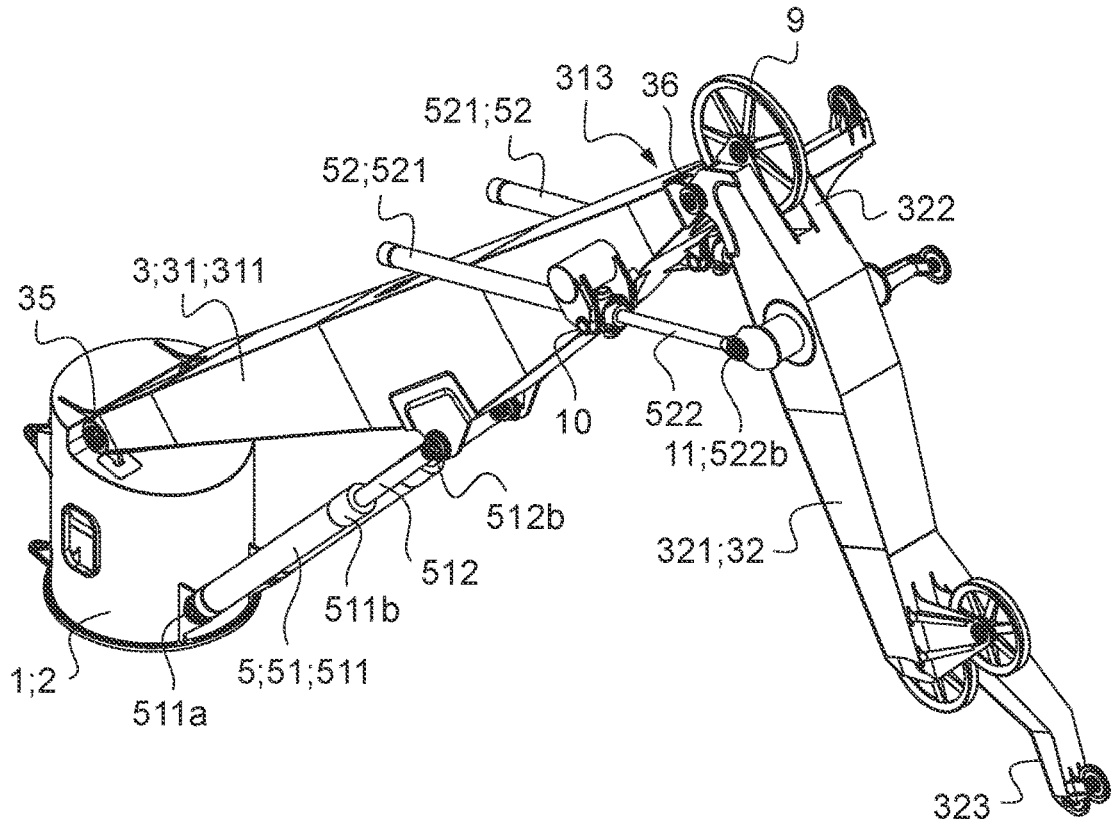
FIG. 4 is an overall and perspective view of the knuckle boom crane according to FIG. 1, whose knuckle boom is now operated to a partially extended configuration.
Figure 5:
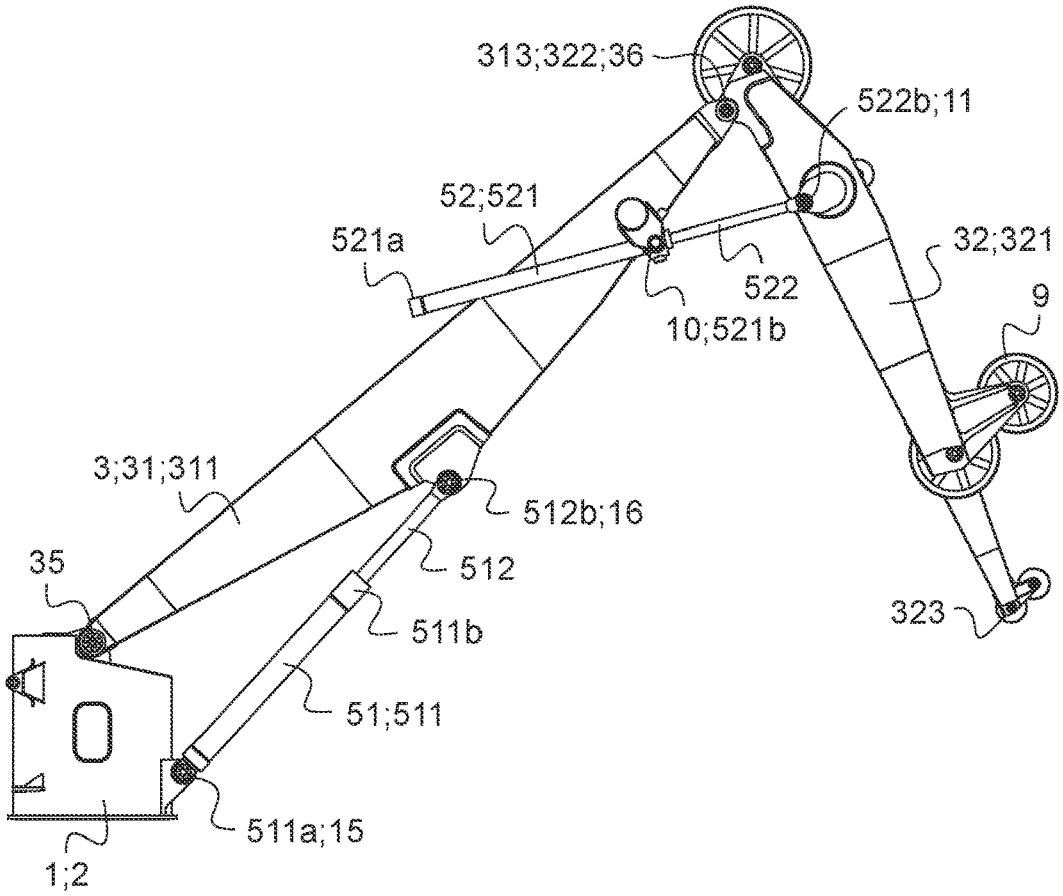
FIG. 5 is an overall and side view of the knuckle boom crane according to FIG. 4.
Figure 6:
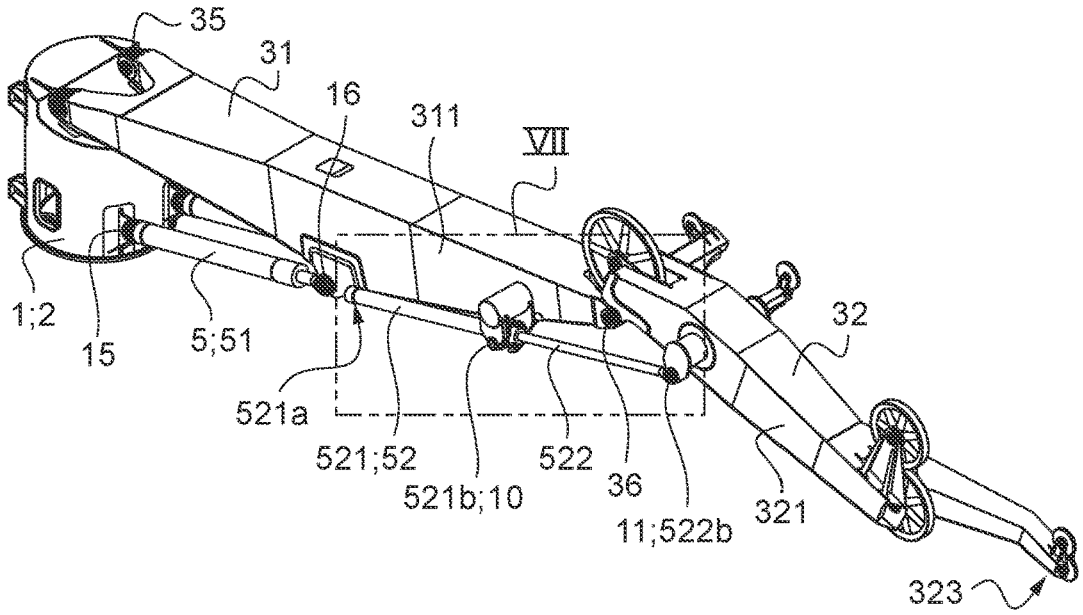
FIG. 6 is an overall and perspective view of the knuckle boom crane, whose knuckle boom is in a fully extended configuration.

It is to be noted that, in these figures, the structural and/or functional elements common to the different variants can be denoted by the same reference numerals.

The knuckle boom crane 1 according to the invention (also called "crane 1") is adapted to offshore applications.

Such a knuckle boom crane 1 is advantageously designed to equip a vessel for offshore application (not shown—also called "offshore vessel"). This crane 1 is hence adapted to be taken on-board the "offshore" vessel.

The term "vessel" includes in particular the marine vessels, in particular the ships, the floating cranes, the offshore barges and platforms.

This crane 1 is hence useful, without being limited thereto, for the installation or the dismantling of the transport infrastructures, the on-board reparations or operations.

As shown in particular in FIG. 1, the crane 1 mainly comprises three elements:

a support structure 2, forming the interface of the crane 1 with the vessel, a knuckle boom 3, carried by the support structure 2 and equipped with operating means 5, and a winch drum 7, associated with rotating means 8 and intended to receive an elongated lift member L (schematically shown in FIG. 1).

The support structure 2 advantageously consists of a barrel or mast, intended to be rotated about a vertical longitudinal axis 2', through operating means (not shown, advantageously hydraulic or electric).

The winch drum 7 and the rotating means 8 form together a winch, advantageously conventional per se.

The rotating means 8 are in particular chosen among the electric or hydraulic motor means.

The knuckle boom 3 is advantageously equipped with pulleys 9, which are sized, distributed and arranged in a customized manner, for guiding the elongated lift member L between the winch drum 7 and the load to be lifted (not shown).

The knuckle boom 3 comprises two boom parts 31, 32 (also called arms or sections), assembled in series from the support structure 2:

a main boom 31, and a terminal boom 32 (also called "jib").

The main boom 31 and the terminal boom 32 each include:

two lateral faces 311, 321, an upstream end 312, 322, located on the side of the support structure 2, and a downstream end 313, 323, remote from the support structure 2.

The main 31 and terminal 32 booms hence advantageously have a generally parallelepipedal shape.

Within each of these boom parts 31, 32, the lateral faces 311, 321 advantageously extend parallel (or approximatively parallel) to each other, preferably vertically.

Figure 8:
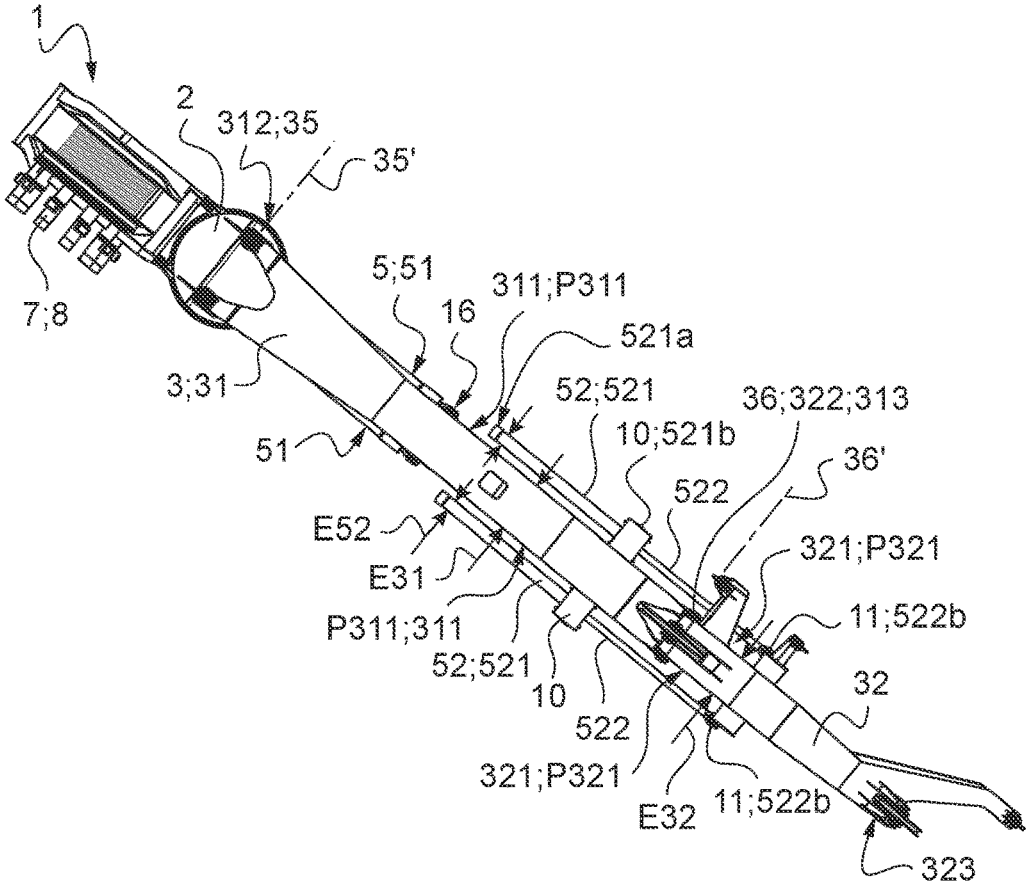
FIG. 8 is an overall and top view of the knuckle boom crane in a fully extended configuration according to FIG. 6.

As illustrated in FIG. 8, the main 31 and terminal 32 booms are each inscribed in a lateral bulk:

the main boom 31 is inscribed in a lateral bulk E31 (also called maximum horizontal width) that is defined by vertical planes P311 passing through its lateral faces 311, and the terminal boom 32 is inscribed in a lateral bulk E32 (also called maximum horizontal width) that is defined by vertical planes P321 passing through its lateral faces 321.

As developed hereinafter, the upstream end 312 of the main boom 31 is assembled with the support structure 2. As for them, the downstream end 313 of the main boom 31 and the upstream end 322 of the terminal boom 32 are assembled together. And the downstream end 323 of the terminal boom 32 is free.

The support structure 2 and the upstream end 312 of the main boom 31 cooperate through upstream articulation means 35 defining an upstream articulation axis 35', advantageously horizontal.

Hence, the main boom 31 is intended to be rotated with respect to the support structure 2, about this upstream articulation axis 35' located at the upstream end 312 thereof.

As for them, the downstream end 313 of the main boom 31 and the upstream end 322 of the terminal boom 32 cooperate through downstream articulation means 36 defining a downstream articulation axis 36', advantageously horizontal.

Hence, the terminal boom 32 is intended to be rotated with respect to the main boom 31, about the downstream articulation axis 36' located at the upstream end 322 thereof.

The upstream 35 and downstream 36 articulation means advantageously consist of knuckles, for example in the form of roller bearings, which are arranged between the assembled ends (for example of the bearing/stud type).

The upstream 35' and downstream 36' articulation axes extend parallel to each other, advantageously horizontally.

The different rotational movements of the boom parts 31, 32 are executed by operating means 5 advantageously associated with control means (not shown).

The operating means 5 of the knuckle boom 3 comprise in particular linear actuators 51, 52, i.e.:

- at least one upstream linear actuator 51 arranged between the support structure 2 and the main boom 31, for the rotational operation of this main boom 31 about the upstream articulation axis 35' thereof, and
- at least one downstream linear actuator 52, arranged between the main boom 31 and the terminal boom 32, for the rotational operation of this terminal boom 32 about the downstream articulation axis 36' thereof.

Generally, the linear actuators 51, 52 advantageously consist of hydraulic jacks, preferably associated with a hydraulic unit (not shown). The linear actuators 51, 52 may also consist of electric jacks.

Each linear actuator 51, 52 advantageously comprises a cylinder 511, 521 and a rod 512, 522.

Each cylinder 511, 521 has two ends:

- an upstream end 511*a*, 521*a*, remote from the rod 512, 522, and
- a downstream end 511*b*, 521*b*, on the side of the rod 512, 522.

As for it, the rod 512, 522 has a free, downstream end 512*b*, 522*b*.

As schematically illustrated in FIG. 8, said at least one downstream linear actuator 52 is inscribed in a cylindrical bulk E52 (also called maximum horizontal width).

By "cylindrical bulk", it is meant in particular the external bulk defined by said at least one downstream linear actuator 52, in particular its cylinder 521.

And according to the invention, said at least one downstream linear actuator 52 is herein fastened at two particular points to the boom parts 51, 52, i.e.:

- on an upstream side, to one of the lateral faces 311 of the main boom 31, and
- on a downstream side, to one of the lateral faces 321 of the terminal boom 32.

Such an arrangement of said at least one downstream linear actuator 52, according to the invention, then provides an improved lever arm between the main boom 31 and the terminal boom 32.

That way, as illustrated in FIG. 8, the cylindrical bulk E52 of said at least one downstream linear actuator 52 advantageously extends out of the lateral bulk E31, E32 of the main 31 and terminal 32 booms (and more particularly, out of the lateral bulk E31, E32 of the part of the main 31 and terminal 32 booms located opposite said at least one downstream linear actuator 52).

In other words, said at least one downstream linear actuator 52 is laterally offset with respect to the boom parts 31, 32, so as to extend opposite the lateral faces 311, 321 of these latter.

Said at least one downstream linear actuator 52 is hence located out of the intermediate space delimited, on the one hand, between the vertical planes P311 of the main boom 31 and, on the other hand, between the vertical planes P321 of the terminal boom 32.

Still according to the invention, the operating means 5 comprise two downstream linear actuators 52, identical and coplanar to each other, implanted on either side of the main boom 31 and of the terminal boom 32.

Each downstream linear actuator 52 is hence fastened to a couple of lateral faces 311, 321 located on a same side of the knuckle boom 3: a lateral face 311 of the main boom 31 and a lateral face 321 of the terminal boom 32, located on a same side of the knuckle boom 3.

Said at least one downstream linear actuator 52 is fastened, through assembly means 10, 11, to the two lateral faces 311, 321, i.e.:

- upstream assembly means 10, at one of the lateral faces 311 of the main boom 31, advantageously defining at least one rotational degree of freedom parallel to the upstream 35' and downstream 36' articulation axes, and
- downstream assembly means 11, at one of the lateral faces 321 of the terminal boom 32, advantageously defining at least one rotational degree of freedom parallel to the upstream 35' and downstream 36' articulation axes.

Still more precisely, the upstream assembly means 10 are herein fastened to the cylinder 521 of the downstream linear actuator 52, remote from the upstream end 521*a* thereof, advantageously at the downstream end 521*b* thereof.

Preferably, the upstream assembly means 10 are herein fastened to the closing ring 521*b* of the cylinder 521 of the downstream linear actuator 52.

Said downstream linear actuator 52 then extends on either side of the upstream assembly means 10.

The cylinder 521 of the downstream linear actuator 52 is hence intended to pivot about the downstream end 521*b* thereof, at the downstream assembly means 10.

This cylinder 521 of the downstream linear actuator 52 extends, partially or fully, in protrusion (or in cantilever) with respect to the upstream assembly means 10 (upstream side).

With respect to the downstream assembly means 10, the cylinder 521 then extends on the side of the support structure 2 and the rod 522 extends on the side of the terminal boom 32.

In other words, the cylinder 521 extends opposite one of the lateral faces 311 of the main boom 31; and the rod 522 extends opposite one of the lateral faces 321 of the terminal boom 32 and one of the lateral faces 311 of the main boom 31.

Figure 7:
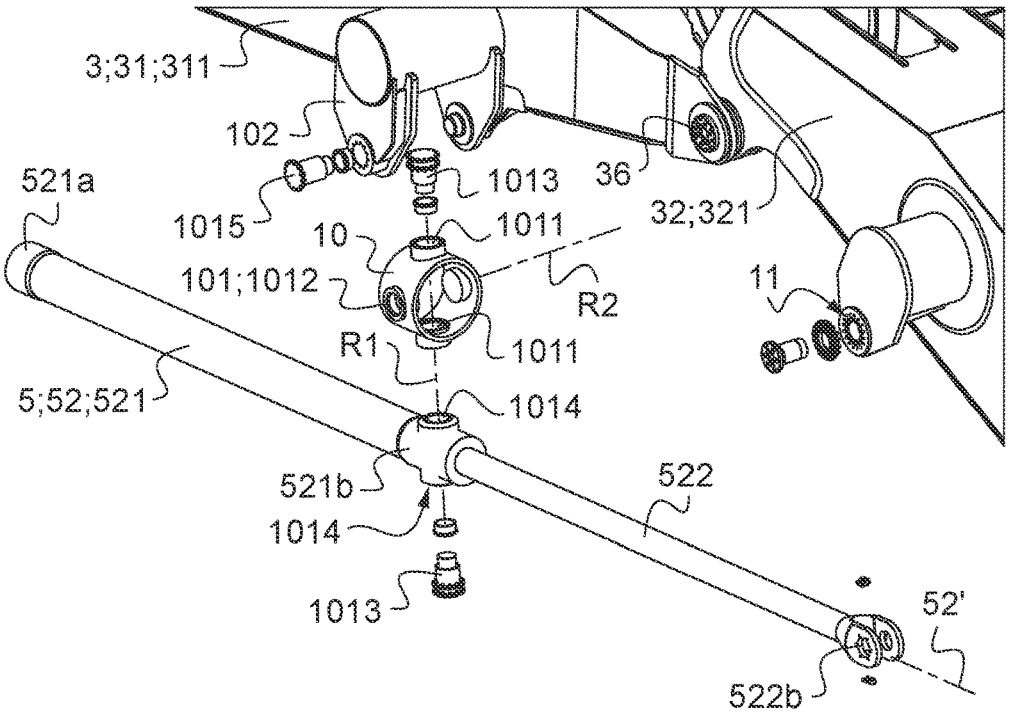
FIG. 7 is a partial and enlarged view of the detail VII of FIG. 6, showing the assembly means of the downstream linear actuator in an exploded configuration.

As illustrated in FIG. 7, said at least one downstream linear actuator 52 is advantageously fastened, through different assembly means 10, 11, to the two lateral faces 311, 321:

- the upstream assembly means 10 are in the form of a universal joint, at one of the lateral faces 311 of the main boom 31, and
- the downstream assembly means 11 are in the form of a ball joint, at one of the lateral faces 321 of the terminal boom 32.

Such a combination of upstream assembly means 10 and downstream assembly means 11, in particular the "ball joint" function of the upstream assembly means 10, provides said at least one downstream linear actuator 52 with an optimized buckling length, releases the rotations and eliminates the parasitic moments, in particular the parasitic bending moments.

The upstream assembly means 10 herein comprise:

a spider 101, carrying said at least one downstream linear actuator 52 with a first rotational degree of freedom R1, and at least one yoke 102, fastened to one of the lateral faces 311 of the main boom 31 and carrying the spider 101 with a second rotational degree of freedom R2.

The spider 101 hence defines two rotational degrees of freedom R1, R2, perpendicular to each other (advantageously, a vertical axis of rotation R1 and a horizontal axis of rotation R2).

These axes of rotation R1, R2 advantageously intersect each other at the longitudinal axis 52' of the downstream linear actuator 52.

For that purpose, the spider 101 herein consists of a ring within which in inserted the downstream end 521*b* of the cylinder 521 of the downstream linear actuator 52.

The ring 101 includes two pairs of concentric orifices 1011, 1012 each defining one of the two rotational degrees of freedom R1, R2.

Two first concentric orifices 1011 receive studs 1013 cooperating with complementary concentric blind orifices 1014, carried by the downstream end 521*b* of the cylinder 521 of the downstream linear actuator 52 (advantageously arranged on the closing ring 521*b* on the rod side, denoted by the same reference 521*b* for the sake of simplicity), to herein define the vertical axis of rotation R1.

Two second concentric orifices 1012 receive studs 1015 carried by the yoke 102 (an added one and a fixed one), to herein define the horizontal axis of rotation R2.

As for them, the downstream assembly means 11 are fastened to the free end 522*b* of the rod 522.

Still generally, said at least one downstream linear actuator 52 is advantageously fastened to one of the lateral faces 321 of the terminal boom 32, remote from the downstream articulation means 36.

Moreover, said at least one upstream linear actuator 51 is itself fastened, on the one hand, to the support structure 2 and, on the other hand, to the main boom 31.

Said at least one upstream linear actuator 51 is fastened at two points:

to the support structure 2, through an upstream assembly means 15 in the form of a knuckle, and to the main boom 31, through a downstream assembly means 16 in the form of a knuckle.

Herein, the upstream linear actuator 51 is fastened, on the one hand, to the upstream assembly means 15 at the upstream end 511*a* of its cylinder 51, and on the other hand, to the downstream assembly means 16 at the free end 512*b* of its rod 512.

The upstream linear actuators 51 are also two in number, identical and coplanar to each other, implanted on either side of the main boom 31.

In practice, the knuckle boom 3 is operable by the operating means 5 according to two movements:

the rotational operation of its main boom 31 about its upstream articulation axis 35', by control of said at least one upstream linear actuator 51, and the rotational operation of its terminal boom 32 about its downstream articulation axis 36', by control of said at least one downstream linear actuator 52.

In particular, said at least one downstream linear actuator 52 according to the invention provides an improved lever arm between the main boom 31 and the terminal boom 32.

During the opening of the terminal boom 32, the downstream linear actuator 52 is intended to oscillate about the first rotational degree of freedom R1 (horizontal) defined by the upstream assembly means 10.

The mounting of the cylinder 521 of the downstream linear actuator 52 at its downstream end 521*b*, through upstream assembly means 10, further optimizes the buckling length that is limited only to the extended rod length 522 (and no longer to the total length of this downstream linear actuator 52).

In case of buckling phenomenon, the downstream linear actuator 52 has also a rotational clearance according to the first rotational degree of freedom R1 (horizontal) and the second rotational degree of freedom R2 (vertical), also defined by the upstream assembly means 10.

The "ball joint" functions of the assembly means 10, 11 release the rotations and eliminate the parasitic moments, in particular the parasitic bending moments.

Of course, various other modifications can be brought to the invention within the framework of the appended claims.

The invention claimed is:

1. A knuckle boom crane for offshore application, wherein said crane comprises:

a support structure (2), a knuckle boom (3), carried by said support structure (2) and equipped with operating means (5), a winch drum (7), associated with rotating means (8) and intended to receive an elongated lift member (L), wherein said knuckle boom (3) comprises a main boom (31) and a terminal boom (32), in series, each comprising:

two lateral faces (311, 321), an upstream end (312, 322), located on the side of the support structure (2), and a downstream end (313, 323), remote from the support structure (2), wherein said support structure (2) and said upstream end (312) of the main boom (31) cooperate through upstream articulation means (35) defining an upstream articulation axis (35'), wherein said downstream end (313) of the main boom (31) and said upstream end (322) of the terminal boom (32) cooperate through downstream articulation means (36) defining a downstream articulation axis (36'), said operating means (5) of said knuckle boom (3) comprise:

at least one upstream linear actuator (51) arranged between said support structure (2) and said main boom (31), for the rotational operation of said main boom (31) about said upstream articulation axis (35'), and at least one downstream linear actuator (52), arranged between said main boom (31) and said terminal boom (32), for the rotational operation of said terminal boom (32) about said downstream articulation axis (36'), wherein said at least one downstream linear actuator (52) is fastened to one of the lateral faces (311) of said main boom (31) and to one of the lateral faces (321) of said terminal boom (32), and wherein said at least one downstream linear actuator (52) is fastened to:

one of the lateral faces (311) of said main boom (31) through upstream assembly means (10) in the form of a universal joint, and one of the lateral faces (321) of said terminal boom (32) through downstream assembly means (11) in the form of a ball joint.

2. The knuckle boom crane according to claim 1, wherein said at least one downstream linear actuator (52) is inscribed in a cylindrical bulk (E52), wherein said main (31) and terminal (32) booms are each inscribed in a lateral bulk (E31, E32) defined by vertical planes (P311, P321) passing through said lateral faces (311, 321), and wherein said cylindrical bulk (E52) of said at least one downstream linear actuator (52) extends out of the lateral bulk (E31, E32) of said main (31) and terminal (32) booms.

3. A vessel for offshore application, equipped with the knuckle boom crane (1) according to claim 2.

4. The knuckle boom crane according to claim 1, wherein the operating means (5) comprise two downstream linear actuators (52), identical and coplanar to each other, implanted on either side of said main boom (31) and of said terminal boom (32).

5. A vessel for offshore application, equipped with the knuckle boom crane (1) according to claim 4.

6. The knuckle boom crane according to claim 1, wherein the upstream assembly means (10) comprise:

a spider (101) carrying said at least one downstream linear actuator (52), and at least one yoke (102), carrying said spider (101) and assembled to the lateral face (311) of said main boom (31).

7. A vessel for offshore application, equipped with the knuckle boom crane (1) according to claim 6.

8. The knuckle boom crane according to claim 1, wherein said at least one upstream linear actuator (51) and said at least one downstream linear actuator (52) comprises a cylinder (511, 521) and a rod (512, 522), said cylinder (511, 521) includes an upstream end (511*a*, 521*a*), remote from the rod (512, 522), and a downstream end (511*b*, 521*b*), on the side of the rod (512, 522), and wherein said at least one downstream linear actuator (52) is fastened to:

one of the lateral faces (311) of said main boom (31) through upstream assembly means (10), and one of the lateral faces (321) of said terminal boom (32) through downstream assembly means (11), and wherein the upstream assembly means (10) are fastened to said cylinder (521), remote from said upstream end (521*a*), and wherein the downstream assembly means (11) are fastened to the free end (522*b*) of said rod (522).

9. The knuckle boom crane according to claim 8, wherein the upstream assembly means (10) are fastened to said cylinder (521), remote from said upstream end (521*a*), at said downstream end (521*b*).

10. The knuckle boom crane according to claim 9, wherein the upstream assembly means (10) are fastened to a closing ring (521*b*) of the cylinder (521) of the downstream linear actuator (52).

11. The knuckle boom crane according to claim 10, wherein the cylinder (521) of the downstream linear actuator (52) fully extends in protrusion with respect to the upstream assembly means (10).

12. A vessel for offshore application, equipped with the knuckle boom crane (1) according to claim 10.

13. The knuckle boom crane according to claim 9, wherein the cylinder (521) of the downstream linear actuator (52) fully extends in protrusion with respect to the upstream assembly means (10).

14. A vessel for offshore application, equipped with the knuckle boom crane (1) according to claim 9.

15. The knuckle boom crane according to claim 8, wherein the cylinder (521) of the downstream linear actuator (52) partially extends in protrusion with respect to the upstream assembly means (10).

16. A vessel for offshore application, equipped with the knuckle boom crane (1) according to claim 8.

17. The knuckle boom crane according to claim 1, wherein said at least one upstream linear actuator (51) and said at least one downstream linear actuator (52) consists of a hydraulic jack or an electric jack.

18. A vessel for offshore application, equipped with the knuckle boom crane (1) according to claim 1.

* * * * *